US011638920B2

(12) United States Patent
Schlaubitz et al.

(10) Patent No.: US 11,638,920 B2
(45) Date of Patent: May 2, 2023

(54) THERMOCYCLING OF A BLOCK COMPRISING MULTIPLE SAMPLE

(71) Applicant: Roche Molecular Systems, Inc., Pleasanton, CA (US)

(72) Inventors: Thomas Schlaubitz, Meggen (CH); Torsten Burdack, Munich (DE); Paul Federer, Wolhusen (CH); Christian George, Wolfratshausen (DE); Guido Grueter, Gisikon (CH); Andreas Scholle, Landsberg am Lech (DE); Guenter Tenzler, Munich (DE)

(73) Assignee: Roche Molecular Systems, Inc., Pleasanton, CA (US)

( * ) Notice: Subject to any disclaimer, the term of this patent is extended or adjusted under 35 U.S.C. 154(b) by 0 days.

(21) Appl. No.: 17/673,116

(22) Filed: Feb. 16, 2022

(65) Prior Publication Data

US 2022/0168744 A1 Jun. 2, 2022

Related U.S. Application Data

(60) Division of application No. 16/058,135, filed on Aug. 8, 2018, now Pat. No. 11,285,488, which is a continuation of application No. 11/912,557, filed as application No. PCT/EP2006/003003 on Apr. 3, 2006, now abandoned.

(30) Foreign Application Priority Data

Apr. 4, 2005 (EP) ..... 05007267

(51) Int. Cl.
*B01L 7/00* (2006.01)

(52) U.S. Cl.
CPC ..... *B01L 7/52* (2013.01); *B01L 2300/06* (2013.01); *B01L 2300/0829* (2013.01); *B01L 2300/1822* (2013.01); *B01L 2300/1855* (2013.01)

(58) Field of Classification Search
CPC ..... B01L 7/52
See application file for complete search history.

(56) References Cited

U.S. PATENT DOCUMENTS

| | | | |
|---|---|---|---|
| 4,819,011 | A | 4/1989 | Yokota |
| 6,233,944 | B1 | 5/2001 | Yamada et al. |
| 6,351,951 | B1 | 3/2002 | Guo et al. |
| 6,880,346 | B1 | 4/2005 | Tseng et al. |
| 2002/0062648 | A1 | 5/2002 | Ghoshal |
| 2002/0139123 | A1 | 10/2002 | Bell |
| 2005/0145273 | A1 | 7/2005 | Dahm et al. |
| 2006/0124280 | A1 | 6/2006 | Lee et al. |
| 2006/0228268 | A1 | 10/2006 | Heimberg et al. |

FOREIGN PATENT DOCUMENTS

WO 200151209 A1 7/2001

*Primary Examiner* — Jonathan M Hurst
(74) *Attorney, Agent, or Firm* — Dinsmore & Shohl LLP

(57) ABSTRACT

The present invention relates to the field of high throughput analysis of samples. In particular, the present invention is directed to a device, a System and a method for simultaneous tempering of multiple samples. More particular, the invention relates to the simultaneous thermocycling of multiple samples to perform PCR in a microtiter plate format.

10 Claims, 6 Drawing Sheets

THERMOCYCLING OF A BLOCK COMPRISING MULTIPLE SAMPLE

CROSS REFERENCE TO RELATED APPLICATIONS

This application is a divisional of U.S. continuation application Ser. No. 16/058,135 filed on Aug. 8, 2018, which is a continuation of U.S. application Ser. No. 11/912,557 filed on Oct. 25, 2007, which is a § 371 of International Application No. PCT/EP2006/03003 filed on Apr. 3, 2006, and which claims the benefit of priority document (EP) 05007267.7 filed Apr. 4, 2005, the entire disclosures of which are incorporated herein by this reference.

FIELD OF INVENTION

The present invention relates to the field of high throughput analysis of samples. In particular, the present invention is directed to a device, a system and a method for simultaneous tempering of multiple samples.

PRIOR ART BACKGROUND

Devices for tempering samples or reaction mixtures in a controlled way are used in almost all fields of chemistry or biochemistry, whereas basic science is affected in the same manner than industrial development or pharmaceutical production. Since labor time as well as reagents are expensive, development is tending to increase the throughput of production and analysis, while at the same time, to minimize the necessary reaction volumes.

In general tempering devices have a thermal block that is in thermal contact with the sample under investigation. The thermal block is tempered to a desired temperature affecting the temperature of the sample, too. The simplest thermal block is a common boilerplate.

In order to realize an efficient tempering, the device should have means to heat and cool the samples. For this purpose, the thermal block can be connected with two separate means or with a single means able to perform both heating and cooling.

Such a single tempering means is e.g. a flow-through means, whereas a pipe system within or close to the thermal block is streamed with an externally tempered fluid, e.g. water or oil, transporting heat to or from the thermal block. In case of two separate means, in general a resistive heating in combination with a dissipative cooling is utilized. A good summary about thermal management in the field of medical and laboratory equipment is written by Robert Smythe (Medical Device & Diagnostic Industry Magazine, fan. 1998, p. 151-157) and the following is an excerpt of this article.

A common dissipative cooling device is a heat sink in combination with a fan. Generally, heat sinks are made from aluminum because of the metal's relatively high thermal conductivity and low cost. They are extruded, stamped, bonded, cast, or machined to achieve a shape that will maximize surface area, facilitating the absorption of heat by the surrounding cooler air. Most have a fin or pin design. When used with fans (forced convection), heat sinks can dissipate large amounts of heat while keeping the targeted components at 10-15° C. above ambient temperature. Heat sinks are inexpensive and offer installation flexibility but cannot cool components at or below ambient temperature. Also, heat sinks do not permit temperature control.

More sophisticated setups utilize thermoelectric devices (TEC) as heat pumps for heating and active cooling of a thermal block. Thermoelectric devices are solid-state heat pumps made from semiconductor materials comprising a series of p-type and n-type semiconductor pairs or junctions sandwiched between ceramic plates. Heat is absorbed by electrons at the cold junction as they pass from a low energy level in a p-type element to a higher energy level in an n-type element. At the hot junction, energy is expelled to e.g. a heat sink as the electrons move from the high-energy n-type element to a low-energy p-type element. A dc power supply provides the energy to move the electrons through the system. A typical TEC will contain up to 127 junctions and can pump as much as 120 W of heat. The amount of heat pumped is proportional to the amount of current flowing through the TEC and therefore, tight temperature control is possible. By reversing the current, TECs can function as heaters or coolers, which can be useful in controlling an object in changing ambient environments or in cycling at different temperatures. Sizes range from 2 to 62 mm, and multiple TECs can be used for greater cooling. Because of the relatively large amount of heat being pumped over a small area, TECs in general require a heat sink to dissipate the heat into the ambient environment. A well known type of TECs is the Peltier elements.

The dissipation of heat is essential for efficient cooling. If the heat can not be dissipated at its origin, said heat can be transferred to another place using heat pipes. A heat pipe is a sealed vacuum vessel with an inner wick structure that transfers heat by the evaporation and condensation of an internal working fluid. Ammonia, water, acetone, or methanol are typically used, although special fluids are used for cryogenic and high-temperature applications. As heat is absorbed at one side of the heat pipe, the working fluid is vaporized, creating a pressure gradient within the heat pipe. The vapor is forced to flow to the cooler end of the pipe, where it condenses, giving up its latent heat to the wick structure and than to the ambient environment via e.g. a heat sink. The condensed working fluid returns to the evaporator via gravity or capillary action within the inner wick structure. Because heat pipes exploit the latent heat effect of the working fluid, they can be designed to keep a component near ambient conditions. Though they are most effective when the condensed fluid is working with gravity, heat pipes can work in any orientation. Heat pipes are typically small and highly reliable, but they can not cool objects below ambient temperature.

A thermal block can be tempered with two heat pipes, whereas one heat pipe transports heat from a heat source to said thermal block and whereas the other heat pipe transports heat away from said thermal block. A thermal block with two heat pipes is disclosed in WO 01/51209. A plurality of heat pipes are used in U.S. Pat. No. 4,950,608 to realize a temperature regulating container. A heat pipe with a controllable thermal conductance is disclosed in U.S. Pat. No. 4,387,762.

Besides the heat pipes, the evaporated solid state enclosure with a liquid-vapor equilibrium in form of a pipe, these solid state enclosure are also known in a plate-like form produced by the company Thermacore (Lancester, USA), called Therma-Base™. These Therma-Base™ have a substantially planar shape and are used e.g. in computers to distribute heat generated at integrated circuits (U.S. Pat. No. 6,256,199). An apparatus for temperature regulation of elements in thermal contact with a fluid contained in liquid-vapor equilibrium inside an enclosure is disclosed in U.S. Pat. No. 5,161,609. U.S. Pat. No. 5,819,842 describes a temperature control unit comprising a spreader plate for the independent control of multiple samples which are in close proximity.

Thus, it was the object of the present invention to provide a device for the simultaneous tempering of samples. In one aspect of the present invention, the invention relates to simultaneous thermocycling of multiple samples to perform PCR in a microtiter plate format.

BRIEF DESCRIPTION OF THE INVENTION

The invention is directed to a device to temper a plurality of individual samples in a parallel manner. More precisely, the invention is directed to a device suitable to perform a plurality of simultaneous PCR amplification within multiple samples.

One subject matter of the present invention is a device for the simultaneous thermocycling of multiple samples comprising:

a) a thermal block 1 comprising said multiple samples,
b) at least one heat pump 2,
c) a thermal base 4,
d) a heat sink 5 and
e) a control unit 3 to control said simultaneous thermocycling of multiple samples, wherein said thermal base 4 is in thermal contact with said heat sink 5 and with said at least one heat pump 2, said at least one heat pump 2 is in thermal contact with said thermal block 1.

Another subject matter of the present invention is a device for the simultaneous thermocycling of multiple samples comprising:

a) a thermal block 1 comprising said multiple samples,
b) at least one heat pump 2,
c) a first thermal base 4 and a second thermal base 6,
d) a heat sink 5 and
e) a control unit 3 to control said simultaneous thermocycling of multiple samples.

Throughout the present invention, the simultaneous thermocycling of multiple samples comprises all kinds of tempering of a plurality of samples. Simultaneous thermocycling summarizes a cyclic variation of the temperature of said multiple samples, whereas the temperature at the beginning of one cycle is the same as the temperature at the end of said cycle. One temperature cycle comprises phases of heating, cooling and phases of constant temperature. The temperature variation with time is summarized by the thermocycling protocol.

The phrase multiple samples comprises any number of samples, whereas said multiple samples can be arrange in several ways. A common way to arrange multiple samples is the use of microtiter plates. Alternatively, multiple reaction vessels may be arranged in a holding means. Within the scope of the present invention, the multiple samples are fluid samples. Each of said multiple samples comprises a solvent and one or more solved targets to be analyzed.

A thermal block 1 is a solid state device disposed to have a good thermal conductance. There is a plurality of materials known to someone skilled in the art that have a good thermal conductance and without being bound to theory, most materials having a good electrical conductance are good thermal conductors, too. Therefore, materials like copper, aluminum, silver or graphite are suitable for the thermal block. On the other hand, also plastics and ceramics may have sufficient thermal conductance to be used as material for the thermal block.

A heat pump 2 is an active device that is able to transport heat. In general heat pumps are so-called thermoelectric devices (TEC) made from semiconductor materials that need electricity to work. A dc power supply provides the energy for heating and cooling, whereas reversing the current does reverse the direction of heat being pumped. A well known type of TECs are the Peltier elements.

A thermal base 4 is a vapor chamber device for transporting and distributing heat. Throughout the present invention a thermal base is a special heat pipe, whereas said thermal base has regions of substantially planar shape. The term heat pipe is an established name for a sealed vacuum vessel with an inner wick structure that transfers heat by the evaporation and condensation of an internal working fluid. As heat is absorbed at one side of the heat pipe, the working fluid is vaporized, creating a pressure gradient within said heat pipe. The vapor is forced to flow to the cooler end of the heat pipe, where it condenses, giving up its latent heat to the ambient environment. The condensed working fluid returns to the evaporator via gravity or capillary action within the inner wick structure. A thermal base in general is a passive device, but it can be designed as an active device, too, if said thermal base is equipped with control means. Said control means modify the thermal conductivity of the thermal base by adjusting either the flow rate within the enclosure or the volume of the enclosure affecting the vacuum within the vessel.

A heat sink 5 is a device to dissipate heat. In general, a heat sink is made out of a thermally conductive material analogous to the thermal block outlined before. Therefore, heat sinks are mostly made out of metal, preferably out of aluminum or copper. Another suitable material for heat sinks is graphite. Alternatively, heat sinks may be formed out of plastics and ceramics, if only a good thermal conductance is realized. In order to realize a maximum dissipation of heat, heat sinks are disposed to provide a large surface-to-volume ratio. This is realized by an assembly of fins arranged on a base plate. A large surface-to-volume ratio reduces the heat transfer resistance between the heat sink and the surrounding air.

A control unit 3 is a device to control said simultaneous thermocycling of multiple samples. Within the present invention said control unit adjusts the power supply of the heat pumps, modifying the amount of heat transported to or transported from the thermal block. Additionally, the control unit may operate the optional control means of the thermal bases.

Yet another aspect of this invention is a method for the simultaneous thermocycling of multiple samples comprising the steps a) providing a thermal block 1 with multiple recesses, at least one heat pump 2, a first thermal base 4, optionally a second thermal base 6, a heat sink 5 and a control unit 3,
b) arranging said thermal block 1 with multiple recesses, said at least one heat pump 2, said first thermal base 4, optionally said second thermal base 6 and said heat sink 5, wherein
said heat sink 5 is in thermal contact with said first thermal base 4,
said first thermal base 4 is in thermal contact with said at least one heat pump 2 and
said at least one heat pump 2 is either in thermal contact with said thermal block 1 or optionally in thermal contact with said second thermal base 6,
said second thermal base 6 being in thermal contact with said thermal block 1, c) placing said multiple samples within the recesses of said thermal block 1 and d) performing a thermocycling protocol with said control unit 3.

Still another aspect of this invention is a system for the simultaneous thermocycling of multiple samples in order to perform multiple nucleic acid amplification reactions comprising a) a device according to the present invention and b) reagents necessary to perform said multiple nucleic acid amplification reactions.

DETAILED DESCRIPTION OF THE INVENTION

One subject matter of the present invention is a device for the simultaneous thermocycling of multiple samples comprising:

a) a thermal block 1 comprising said multiple samples, b) at least one heat pump 2, c) a thermal base 4, d) a heat sink 5 and e) a control unit 3 to control said simultaneous thermocycling of multiple samples, wherein said thermal base 4 is in thermal contact with said heat sink 5 and with said at least one heat pump 2, said at least one heat pump 2 is in thermal contact with said thermal block 1.

There are a large number of devices known to a person skilled in the art that are able to temper a sample in a cyclic fashion. The phrase thermocycling summarizes a cyclic variation of the temperature of a sample, whereas the temperature at the beginning of one cycle is the same as the temperature at the end of said cycle. One temperature cycle comprises phases of heating, cooling (temperature ramps) and phases of constant temperature. The temperature variation with time is summarized by the phrase "thermocycling protocol".

If the device should be able to simultaneously temper an assembly of multiple samples, e.g. the wells of a microtiter plate, and the results of the experiments within the multiple samples should be comparable, one has to guarantee that the thermocycling of the samples in the center of the assembly and at the boarder of the assembly are preferably identical. Moreover, it is desirable to perform the temperature ramps of the thermocycling protocol as fast as possible, but without overshooting the temperatures of the multiple samples when reaching the phases of constant temperature.

In a preferred embodiment of the device according to the present invention, said thermal block 1 is made out of a thermally conductive material.

Thermally conductive materials are materials that have a good thermal conductivity and low heat capacity. In heat transfer analysis the ratio of thermal conductivity and heat capacity is also defined as thermal diffusivity $$\alpha = k/(\rho \cdot c_p)$$

where k is the thermal conductivity, measured in W/(m·K), $\rho \cdot c_p$ is the volumetric heat capacity, measured in J/(m$^3$·K). The SI unit of the thermal diffusivity is m$^2$/s.

Substances with high thermal diffusivities rapidly adjust their temperatures to that of their surroundings, because they conduct heat quickly in comparison to their thermal bulk. Thermally diffusive materials are materials having a good thermal conductivity, and without being bound to theory, most materials having a good electrical conductance also have a good thermal diffusivity, too.

On the other hand, although they have much smaller thermal diffusivities, there are also some plastics, ceramics and polymers that have sufficient thermal properties for the present invention. Plastics have thermal diffusivities of up to $\alpha=0.2\cdot10^{-6}$ m$^2$/s, ceramics of up to $\alpha=0.4\cdot10^{-6}$ m$^2$/s. Polymeric materials e.g. can have thermal conductivities of up to k=10 Wm$^{-1}$K$^{-1}$.

In a more preferred embodiment of the device according to the present invention, said thermal block 1 is made out of metal, preferably out of aluminum or silver.

There is a plurality of metallic materials known to someone skilled in the art that have a good thermal conductance and that are suitable for the thermal block, e.g. copper, aluminum or silver. Copper for example has a thermal diffusivity of about $\alpha=107\cdot10^{-6}$ m$^2$/s, silver of about $\alpha=166\cdot10^{-6}$ m$^2$/s, whereas aluminum has about of about $\alpha=93\cdot10^{-6}$ m$^2$/s (all at 300 K). Nevertheless, aluminum is a preferred material, because it is cheap and easy to process. Note that in the majority of cases the metallic materials are not pure but alloys, whereas the thermal conductance of the material will be depending on the composition of said alloy.

In general, the thermal block 1 of the present invention is a cuboid with a top-view cross section area A, a length 1, a width w and a height h, having the preferred dimensions of 1=5-200 mm, w=5-200 mm and h=3-100 mm.

In another preferred embodiment of the device according to the present invention, said thermal block 1 comprises recesses 7 disposed to receive said multiple samples.

In this embodiment of the device according to the present invention, the thermal block 1 is equipped with multiple recesses 7, whereas said recesses 7 are arranged on the top side reaching to the inside of said thermal block 1. It is preferred that said recesses have all the same size. Said recesses 7 may be obtained by drilling in a homogeneous thermal block 1. Alternatively, said drilling in a homogeneous thermal block 1 may be performed in such a way that the recesses 7 form holes crossing the entire height of the thermal block 1. Besides the method of drilling in a homogeneous thermal block 1, other methods like molding, electroforming, deep drawing or electrical discharge machining may be used to manufacture the thermal block with recesses.

In a further preferred embodiment of the device according to the present invention, said multiple samples are placed directly in said recesses 7 of the thermal block 1 or via reaction vessels each comprising one of said multiple samples.

The recesses 7 are disposed to receive said multiple samples, whereas several possibilities are applicable within the scope of the present invention. In one embodiment, the multiple samples are positioned in said recesses 7 directly via e.g. a pipetting step. If necessary, the recesses 7 may be coated with a material that is inert for the samples and that is cleanable to recycle the thermal block 1 for further use. In another embodiment, the multiple samples are positioned in said recesses 7 via reaction vessels, said reaction vessels are justified to said recesses 7. It is of importance that reaction vessels and the recesses 7 are justified, because otherwise air between both components may act as a thermal isolator hindering the thermal contact.

In an also preferred embodiment of the device according to the present invention, said reaction vessels are linked to form one or more groups, preferably said reaction vessels are linked to form a multiwell plate.

Each of said multiple recesses 7 can receive a separate reaction vessel or one or more groups of linked reaction vessels can be positioned in said multiple recesses 7. A well-known single reaction vessel suitable for the present invention is e.g. an Eppendorf cup, whereas a suitable group of linked reaction vessels is e.g. an Eppendorf cup strip or a microtiter plate having e.g. 96, 384 or 1536 individual wells.

In yet another preferred embodiment of the device according to the present invention, said at least one heat pump 2 is a thermoelectric device, preferably a semiconductor device, more preferably a Peltier element.

A heat pump 2 is an active element that needs electricity to generate and/or transport heat and that is also named thermoelectric devices (TEC) in literature. In general, TEC heat pumps 2 are solid-state heat pumps made from semiconductor materials comprising a series of p-type and n-type semiconductor pairs or junctions sandwiched between ceramic plates. A dc power supply provides the energy to move the electrons through the system thereby transporting heat. A typical TEC will contain up to 127 junctions and can pump as much as 120 W of heat, whereas the amount of heat pumped is proportional to the amount of current flowing through the TEC. Therefore, TECs offer a tight temperature control. By reversing the current, TECs can function as heaters or coolers, which can be useful in controlling an object in changing ambient environments or in cycling at different temperatures. A well known type of TECs are the Peltier elements. Such Peltier elements are commercially available in several different versions with respect to performance, shape and materials. TECs are rectangular or round, they may have centered bore holes for fixation and exist in different heights. Special TECs are optimized to stand extensive switching between the working modes and are applicable of up to 150° C. In general, the semiconductor device is sandwiched between to ceramic plates. These ceramic plates may be equipped with slits to reduce thermal stress. In order to counter the bimetallic effect, the ceramic plates may be covered partly with a metallic material (e.g. copper).

In another preferred variant of the device according to the present invention, said thermal base 4 is a heat conducting device comprising a liquid-vapor equilibrium within a solid state enclosure.

As mentioned before, a thermal base 4 within the scope of the present invention is basically analogous to the heat pipes known to someone skilled in the art, with the difference that the thermal base 4 has at least partially a plate like structure in comparison to the pipe like structure of the heat pipes. In general, heat pipes as well as thermal bases are solid state enclosures with an inner wick structure that transfers heat by the evaporation and condensation of an internal working fluid. In other words, within the sealed vessel a liquid-vapor equilibrium of the internal working fluid persists, whereas the local equilibrium is depending on the local temperature. In more detail, if heat is absorbed at one side of the heat pipe, the working fluid is vaporized, creating a pressure gradient within the heat pipe. The vapor is forced to flow to the cooler end of the pipe, where it condenses, giving up its latent heat to the ambient environment. The condensed working fluid returns to the evaporator via gravity or capillary action within the inner wick structure. Ammonia, water, acetone, or methanol are typically used as work fluids, although special fluids are used for cryogenic and high-temperature applications.

The thermal base has a very high quasi thermal conductivity of up to $2 \cdot 10^5 Wm^{-1}K^{-1}$ and therefore, the spreading of heat across the entire cross section area of the thermal base is very efficient. This on the one hand, increases the homogeneity during the heating process and on the other hand, decrease the required time for the cooling process, because the heat transfer resistance of the heat sink will be further reduced.

A preferred variant of the device according to the present invention comprises a thermal base 4 that is substantially planar.

In a more preferred embodiment of the device according to the present invention said thermal base 4 is free of recesses.

Within the scope of the present invention it is preferred that the thermal base 4 is substantially planar, whereas substantially planar summarizes cuboid thermal bases 4 with a top-view cross section area A, a length 1, a width w and a height h, having the preferred dimensions of 1=10-500 mm, w=10-500 mm and h=3-15 mm.

Throughout the present invention the phrase "free of recesses" is used to emphasize that in certain preferred embodiments of the present invention the thermal base has a continuous top-view cross section area A that is uninterrupted by recesses. In other words, a thermal base that is free of recesses has a planar surface at least in the area of thermal contact with the neighboring device parts.

Within the scope of the present invention the phrase "thermal contact" between two components is used to emphasize that the physical contact between two components has to be optimized towards a high thermal conductance. In other words, throughout the present invention a "thermal contact" is an optimized "physical contact" to improve the thermal conductance between two components. Since air is a poor thermal conductor, one has to guarantee that the amount of air between two components in thermal contact is as small as possible. There are several possibilities to minimize air in the contact zone of two solid state materials, whereas these possibilities can be classified in two groups, namely a direct thermal contact and an indirect thermal contact.

One variant of indirect thermal contact utilizes a paste having a high thermal conductance as linker between the two components, e.g. thermal grease. In another variant of indirect thermal contact preferably a soft, thermally conductive foil, e.g. a graphite foil is used as an interface material between the two components. Such a graphite foil can even a certain roughness of the components and reduces the mechanical stress due to thermal expansion.

On the other hand, it is preferred to apply a mechanical force such that a direct thermal contact is sufficient and no additional interface materials between the two components are needed. It is also preferred that both contact areas are as flat as possible to minimize the air gap between the components. Note that it is of advantage to apply a mechanical force to press together the two components even for the embodiments with indirect thermal contact, because this can further improve the thermal conductance.

In a more preferred variant of the device according to the present invention, said thermal base 4 is in thermal contact with said heat sink 5 and via a graphite foil with said at least one heat pump 2, whereas said at least one heat pump 2 is in thermal contact with said thermal block 1 via a graphite foil as well. If desired, thermal grease may be used as an additional interface material between the thermal base 4 and said heat sink 5.

In yet another preferred variant of the device according to the present invention, said at least one heat pump 2 is used to generate heat and to transport said heat to said thermal block 1.

In a more preferred embodiment of the device according to the present invention, said at least one heat pump 2 is further used for the active transport of heat from said thermal block 1 to said thermal base 4.

By reversing the current, TECs can function either as heaters or as coolers. In the one operation mode the TEC generates heat and said heat is transported to one of the two ceramic plates of the device. In the other operation mode the TEC transports heat from one of the ceramic plate to the other ceramic plate of the device and therefore, actively cools one of the ceramic plates. In other words, while one of the sides of the TEC will be cooled, the other side of the TEC will be heated.

In an also preferred embodiment of the device according to the present invention, the cross section area of said thermal base 4 is by less than 20% larger or smaller than the cross section area of said heat sink 5 and the cross section area of said thermal base 4 is larger than the cross section area of said thermal block 1, said cross section areas are in parallel to the respective contact areas.

During the cooling of the thermal block a large amount of heat has to be dissipated in a short time. If the amount of heat that needs to be dissipated becomes even larger, at first glance this can be encountered by using simply a larger heat sink 5 that accordingly provides a larger surface area for dissipation. This assumption is only correct to some extent, because by using a common metal heat sink 5 with its restricted thermal conductivity only a certain fraction of the surface area close to the heat source will participate in the dissipative process. Therefore, enlarging the cross section area of a common metal heat sink 5 alone is no appropriate way to handle the dissipation of large amounts of heat. Within the present invention, the cross section area is always the cross section area of the device components in top-view. Note that the schematic pictures of several embodiments of the device in FIG. 1 represent side-views of the composition.

Using a thermal base 4 in combination with a heat sink 5 in accordance with the present invention improves the heat dissipation, because the enormous thermal conductance of the thermal base 4 assures that even a heat sink 5 being much larger than the heat source will participate effectively in the dissipative process. The optimization of the dissipative process helps to reduce the required time for the cooling steps within the thermocycling protocol.

In another more preferred variant of the device according to the present invention, said cross section area of said thermal base 4 is larger than the cross section area of said thermal block 1 by at least a factor of 1.5, preferably by at least a factor of 4 and said thermal base 4 has the same cross section area as said heat sink 2, said cross section areas are in parallel to the respective contact areas.

The maximal reasonable ratio of the cross section area of said thermal base 4 and the cross section area of said thermal block 1 is depending on the thermal conductance of the thermal base 4. The same is true for the cross section area ratio of the heat sink 5 and the thermal base 4. Providing a heat sink 5 with a cross section area much larger than that of the said thermal base 4 does not further improve the heat dissipation.

In another more preferred variant of the device according to the present invention, said thermal base is provided with control means 9 to vary the heat conducting properties of said thermal base 4.

It is preferred to provide the thermal base with a control means 9, because if the heat conducting properties of said thermal base may be varied, the influence of said thermal bases may be switched "on" and "off" as desired by the different procedures of the thermocycling protocol. For example, it is desirable to minimize the heat conducting properties of the thermal base 4 for the heating procedure of the thermocycling protocol. If the thermal base 4 can not be switched "off" during the heating procedure, a larger portion of the heat generated at the at least one heat pump 2 will be dissipated immediately at the heat sink 5.

There are several ways to control the heat conducting properties of a thermal base (see e.g. U.S. Pat. No. 5,417,686). In general, the heat conducting properties of a thermal base are depending on the liquid-vapor equilibrium of the internal working fluid affected by the vessel vacuum as well as on the transportation of gas and liquid within the sealed vessel.

A more preferred embodiment according to the present invention is a device, wherein said control means 9 vary the heat conducting properties of a thermal base by changing the volume within said thermal base.

Another more preferred embodiment according to the present invention is a device, wherein said control means 9 vary the heat conducting properties of a thermal base by changing the flow rate within said thermal base.

The liquid-vapor equilibrium of the internal working fluid within a thermal base can be modified by changing the volume of the thermal base. This can be done by providing an additional vessel connected to said thermal base via an opening, whereas the volume of said additional vessel is adjustable. Said additional vessel can be e.g. a syringe or a bellows. Alternatively, the vacuum within said thermal base can be adjusted directly by using a vacuum pump connected to an opening of the vessel. Moreover, the heat conducting properties of the thermal base can be modified by affecting the flow rate within said vessel. Here, a throttling valve is suitable that may be operated from the outside without affecting the vacuum within the vessel that divides the thermal base into compartments.

In a preferred variant of the device according to the present invention, said heat sink 5 is made out of a thermally conductive material.

In a more preferred variant of the device according to the present invention, said heat sink 5 is made out of metal, preferably out of aluminum, cooper, silver or graphite.

Concerning the thermally conductive material of the heat sink 5, the same statements are valid as addressed before with respect to the thermal block 1.

In yet another preferred variant of the device according to the present invention, said heat sink 5 is disposed to provide a maximized surface-to-volume ratio.

Without being bound to theory, the amount of heat that can be dissipated by said heat sink 5 is directly proportional to its surface area. Therefore, it is desirable to provide a heat sink with an optimized surface-to-volume ratio, because of the limited amount of space within the device of the present invention.

In a more preferred variant of the device according to the present invention, said large surface-to-volume ratio is provided by an assembly of fins arranged on a base plate.

Also preferred is a device according to the present invention, wherein said heat sink 5 is cooled by air or by water flow.

An interstitial assembly of fins provides a large surface area, whereas the solid base plate represents the thermal contact area with the thermal base 4. The heat sink 5 dissipates heat to the surrounding. Since this dissipative process is most effective for large temperature differences between the surrounding atmosphere and the heat sink 5, it is desirable to actively cool the surrounding. This can be done either by air flow produced by a fan or by liquid flow produced by e.g. a peristaltic pump.

In yet another preferred variant of the device according to the present invention, said control unit 3 controls the properties of said at least one heat pump 2.

In a more preferred variant of the device according to the present invention, said control unit 3 further controls said control means 9 to vary the heat conducting properties of said thermal base 4.

The device according to the present invention is equipped with a control unit 3. Said control unit 3 is an electric device, e.g. a computer, that controls the power supply of the at least one heat pump 2 and therefore, adjusts their heating or cooling properties. Additionally, said control unit 3 can operate the control means 9 of the thermal base.

Another preferred embodiment according to the present invention is a device, wherein said thermocycling is performed to realize nucleic acid amplifications within said multiple samples.

A more preferred embodiment according to the present invention is a device further comprising a means to monitor said nucleic acid amplifications in real-time.

Within the scope of the present invention all nucleic acid amplifications known to someone skilled in the art are applicable, e.g. the polymerase chain reaction (PCR) the Ligase Chain Reaction (LCR), Polymerase Ligase Chain Reaction, Gap-LCR, Repair Chain Reaction, 3SR, strand displacement amplification (SDA), transcription mediated amplification (TMA) or CV-amplification.

In general, nucleic acid amplifications are monitored in real-time using fluorescence dyes known to someone skilled in the art. To measure the fluorescence signals all kinds of optical means are suitable within the scope of the present invention. Preferred are CCD cameras or photometers that may be utilized with and without additional optical components like lenses, optical filters or folding mirrors.

If a certain application requires that the optical means has to be oriented below the thermal block 1, e.g. to monitor the fluorescence intensity of the multiple samples through bottom holes in said thermal block 1, it is possible to arrange the composition out of a heat sink 5, a first thermal base 4, the heat pumps 2 and optionally a second thermal base 6 sideways of said thermal block 1. To gain a homogeneous thermocycling of the thermal block 1, it is possible to arrange one of said compositions at each of the four sides of said thermal block 1. Alternatively, a single composition may be arranged surrounding the thermal block 1.

Another aspect of the present invention is a device for the simultaneous thermocycling of multiple samples comprising:

a) a thermal block 1 comprising said multiple samples,
b) at least one heat pump 2,
c) a first thermal base 4 and a second thermal base 6,
d) a heat sink 5 and
e) a control unit 3 to control said simultaneous thermocycling of multiple samples.

In this embodiment of the present invention two separate thermal bases 4,6 are used. The first thermal base 4 improves the cooling procedure within the thermocycling protocols by distributing the heat to be dissipated homogeneously across the whole heat sink 5. The second thermal bases 6 improves the heating procedure within the thermocycling protocols by distributing the heat generated at the at least one heat pump 2 homogeneously across the whole thermal block 1.

In yet another preferred variant of the device according to the present invention, said first thermal base 4 is substantially planar.

In a more preferred variant of the device according to the present invention, said first thermal base 4 is substantially planar being in thermal contact with said heat sink 5.

As mentioned before, substantially planar summarizes cuboid thermal bases with a top-view cross section area A, a length 1, a width w and a height h and said first thermal base 4 has the preferred dimensions of 1=10-500 mm, w=10-500 mm and h=3-15 mm. With respect to the thermal contact all possibilities mentioned before are applicable for this preferred variant, too.

In an also preferred variant of the device according to the present invention, said at least one heat pump 2 is in between said two thermal bases 4,6 and said at least one heat pump 2 is in thermal contact with both thermal bases 4,6.

With said at least one heat pump 2 in between said two thermal bases 4,6, the heat pumps 2 are able to transfer heat to the second thermal bases 6 during the heating procedure as well as to transfer heat from the second thermal bases 6 to the first thermal bases 4 during the cooling procedure. In a preferred embodiment of the invention said at least one heat pump 2 are TECs.

It is preferred that there is an additional interface material between said heat pumps 2 and said first thermal bases 4 as well as said second thermal bases 6. In both cases a preferred interface material is a graphite foil as outlined before.

In a more preferred variant of the device according to the present invention, the cross section area of said first thermal base 4 is by less than 20% larger or smaller as the cross section area of said heat sink 5, the cross section area of said first thermal base 4 is larger than the cross section area of said thermal block 1, said second thermal base 6 is substantially planar and said second thermal base 6 is in thermal contact with said thermal block 1, said cross section areas are in parallel to the respective contact areas.

In another more preferred variant of the device according to the present invention, the cross section area of said first thermal base 4 is by less than 20% larger or smaller as the cross section area of said heat sink 5, the cross section area of said first thermal base 4 is larger than the cross section area of said thermal block 1, said second thermal base 6 has a complex shape enclosing part of said thermal block 1 or said thermal block 1 as a whole and said second thermal base 6 is in thermal contact with said thermal block 1, said cross section areas are in parallel to the respective contact areas.

The positive effect of a heat sink 5 as well as a first thermal base 4 that have both a larger cross section area as the thermal block 1 was discussed in detail before. In brief, using a first thermal base 4 in combination with a heat sink 5 improves the heat dissipation, because the enormous thermal conductance of the thermal base 4 assures that even a heat sink 5 being much larger than the heat source will participate effectively in the dissipative process.

The thermal contact of said second thermal base 6 and said thermal block 1 preferably comprises an additional interface material, e.g. thermal grease or a graphite foil.

If only the homogeneous heating of the thermal block without optimized heat dissipation is required, it may be of advantage to provide a device with only said second thermal base 6 without the first thermal base 4. This variation of the device according to the present invention can be done to all embodiments with a first and a second thermal base that is described in this application.

In an even more preferred variant of the device according to the present invention, the cross section area of said first thermal base 4 is larger than the cross section area of said thermal block 1 by at least a factor of 1.5, preferably by at least a factor of 4 and said first thermal base 4 has the same cross section area as said heat sink 2, said cross section areas are in parallel to the respective contact areas.

The reasonable cross section area ratios of said first thermal base 4 and said thermal block 1 as well as of said first thermal base 4 and said heat sink 2 are depending on the thermal conductance of the thermal base 4.

Concerning the cross section area ratio of said second thermal base 6 and said thermal block 1 the same arguments outlined before are valid and it is preferred that said second thermal base 6 and said thermal block 1 have about the same cross section area, preferably the cross section area of said second thermal base 6 is by less than 20% larger or smaller as the cross section area of said thermal block 1. Said second thermal base 6 has the preferred dimensions of l=5-200 mm, w=3-200 mm and h=3-30 mm.

In another preferred embodiment of the device according to the present invention, said at least one heat pump 2 is used to generate heat and to transport said heat to said second thermal base 6.

In a more preferred embodiment of the device according to the present invention, said at least one heat pump 2 is further used for the active transport of heat from said second thermal base 6 to said first thermal base 4.

As mentioned before, when TECs are used as heat pumps, reversing the current of these thermoelectric elements provides either a heating or a cooling device.

A preferred embodiment according to the present invention is a device, wherein said first thermal base 4 and said second thermal base 6 are both free of recesses.

Another preferred embodiment according to the present invention is a device, wherein said first thermal base 4 and/or said second thermal base 6 are provided with control means 9 to vary the heat conducting properties of said thermal bases 4,6.

It is preferred to provide each thermal base with a control means 9, because if the heat conducting properties of said thermal bases may be varied independently, the influence of said thermal bases may be switched "on" and "off" as desired by the different procedures of the thermocycling protocol. For example, in an embodiment with a first 4 and a second thermal base 6, it is desirable to minimize the heat conducting properties of the first thermal base 4 and to maximize the heat conducting properties of the second thermal base 6 for the heating procedure of the thermocycling protocol. If the first thermal base 4 can not be switched "off" during the heating procedure, a larger portion of the heat generated at the at least one heat pump 2 will be dissipated immediately at the heat sink 5.

Note that the ways to control the heat conducting properties of a thermal base as well as the embodiments of heat sink 5, heat pump 2, thermal block 1, control means 9 and control unit 3 as described before are also applicable with respect to the device with a first and a second thermal base 4,6.

In a more preferred variant of the device according to the present invention, said control unit 3 further controls said control means 9 to vary the heat conducting properties of said thermal bases 4,6.

The device according to the present invention is equipped with a control unit 3. Said control unit 3 is an electric device, e.g. a computer, that controls the power supply of the at least one heat pump 2 and therefore, adjusts their heating or cooling properties. Additionally, said control unit 3 can operate the control means 9 of the at least one thermal base 4,6.

Another aspect of this invention is a method for the simultaneous thermocycling of multiple samples comprising the steps a) providing a thermal block 1 with multiple recesses, at least one heat pump 2, a first thermal base 4, optionally a second thermal base 6, a heat sink 5 and a control unit 3,
b) arranging said thermal block 1 with multiple recesses, said at least one heat pump 2, said first thermal base 4, optionally said second thermal base 6 and said heat sink 5, wherein
   said heat sink 5 is in thermal contact with said first thermal base 4,
   said first thermal base 4 is in thermal contact with said at least one heat pump 2 and
   said at least one heat pump 2 is either in thermal contact with said thermal block 1 or optionally in thermal contact with said second thermal base 6, said second thermal base 6 being in thermal contact with said thermal block 1,
c) placing said multiple samples within the recesses of said thermal block 1 and
d) performing a thermocycling protocol with said control unit 3.

The phrase thermocycling protocol summarizes a cyclic variation of the temperature of a sample, whereas the temperature at the beginning of one cycle is the same as the temperature at the end of said cycle. One temperature cycle comprises phases of heating, cooling (temperature ramps) and phases of constant temperature.

As mentioned before, the phrase "thermal contact" between two components is used throughout the present invention to emphasize that the contact has to be optimized towards a high thermal conductance. The thermal contact can be optimized e.g. by a paste, e.g. thermal grease, having a high thermal conductance as linker between the two components or by a soft, thermally conductive foil, e.g. a graphite foil as an intermediate between two components. In all cases it is of advantage, if the two components are pressed together by mechanical force.

In a preferred variant of the method according to the present invention, said first thermal base 4 is in thermal contact with said heat sink 5 and via a graphite foil with said at least one heat pump 2, whereas said at least one heat pump 2 is in thermal contact with said thermal block 1 or with said second thermal base 6 via a graphite foil.

In another preferred variant of the method according to the present invention, said first thermal base 4 is substantially planar.

In a more preferred variant of the method according to the present invention, said first thermal base 4 is free of recesses.

In yet another preferred variant of the method according to the present invention, the cross section area of said first thermal base 4 is by less than 20% larger or smaller than the cross section area of said heat sink 5 and the cross section area of said first thermal base 4 is larger than the cross section area of said thermal block 1, said cross section areas are in parallel to the respective contact areas.

In a more preferred variant of the method according to the present invention, said cross section area of said first thermal base 4 is larger than the cross section area of said thermal block 1 by at least a factor of 1.5, preferably by at least a factor of 4 and said first thermal base 4 has the same cross section area as said heat sink 2, said cross section areas are in parallel to the respective contact areas.

Also preferred is a method according to the present invention, wherein the optional second thermal base 6 is substantially planar.

More preferred is a method according to the present invention, wherein the optional second thermal base 6 is free of recesses.

Further preferred is a method according to the present invention, wherein said optional second thermal base 6 has the same cross section area as said thermal block 1.

The reasons for the above indicated preferred arrangements were already discussed before with respect to the device according to the present invention.

In a preferred embodiment of the method according to the present invention, said optional second thermal base 6 has a complex shape enclosing part of said thermal block 1 or said thermal block 1 as a whole.

In another preferred embodiment of the method according to the present invention, said optional second thermal base 6 has a complex shape replacing the thermal block 1.

The preferred embodiment of the method according to the present invention, wherein a second thermal base 6 has a complex shape provides especially homogeneous tempering of the thermal block 1, because not only the bottom of said thermal block 1 is in thermal contact with the second thermal base 6, but also parts of the side walls or even the thermal block 1 as a whole is coated by the second thermal base 6.

Alternatively to the coating of the thermal block 1 by the second thermal base 6 as a whole, the thermal block 1 may be replaced by a special thermal base 8 that is formed like a thermal block itself.

In yet another preferred embodiment of the method according to the present invention, said multiple samples are placed within said recesses of said thermal block 1 directly or via reaction vessels each comprising one of said multiple samples.

In a more preferred embodiment of the method according to the present invention, said reaction vessels are linked to form one or more groups, preferably said reaction vessels are linked to form of a multiwell plate.

The different options to place the multiple samples in the thermal block 1 were already discussed before with respect to the device according to the present invention.

In a further preferred embodiment of the method according to the present invention, said thermocycling protocol is suitable to perform nucleic acid amplifications within said multiple samples.

Even more preferred is a method according to the present invention, wherein said nucleic acid amplifications are monitored in real-time.

Yet another aspect of this invention is a system for the simultaneous thermocycling of multiple samples in order to perform multiple nucleic acid amplification reactions comprising a) a device according to the present invention and
b) reagents necessary to perform said multiple nucleic acid amplification reactions.

Reagents throughout this application are all kinds of chemicals that are necessary to perform one of the methods outlined above with the aid of the inventive device according to the present invention. These reagents may be liquids or solids, pure materials or mixtures, they may be provided 'ready-to-use' or as concentrates.

In a preferred system according to the present invention, said reagents comprise buffer solutions, detergents, enzymes, nucleotides and primers.

The reagents of this preferred system according to the present invention are the reagents necessary to perform PCR amplifications. In more detail, reagents are a set of single nucleotides, a polymerase, a pair of primers and buffer solutions.

In another preferred system according to the present invention, said multiple nucleic acid amplification reactions are multiple PCR amplifications that are monitored in real-time.

The following examples, sequence listing and figures are provided to aid the understanding of the present invention, the true scope of which is set forth in the appended claims. It is understood that modifications can be made in the procedures set forth without departing from the spirit of the invention.

Example 1

A device according to the present invention for the thermocycling of a 384 multiwell plate comprises a home-made thermal block out of the aluminum alloy AlMgSi 0,5. An aluminum block with the dimension 109×73×9.1 mm was used to form 384 recesses by drilling, each conic recess has a top diameter of 3.44 mm (angle 17°) and a depth of 6.8 mm.

Below said thermal block 6 Peltier elements are arranged, whereas the thermal contact is enhanced via a thermal conductive graphite foil. The used Peltier elements are suitable for multiple thermocycling procedures and can heat up to 130° C. Additionally, each of them has a cooling capacity of 75 W.

Via a second thermal conductive graphite foil, the 6 Peltier elements are arranged on a thermal base. The used thermal base is customized production of Thermacore™ and has the dimension of 248×198×5 mm. The vessel wall is made out of copper and the working fluid is water.

The used heat sink is commercially available from Webra (product number W-209) and is made out of the aluminum alloy AlMgSi 0.5 with the dimension 250×200×75 mm. Between the heat sink and the thermal base a commercial thermal grease is applied in order to enhance the thermal contact.

All four components of the device are fixed together by 17 screws and springs and the dissipative process is enhanced by four fans circulation air at the heat sink.

Example 2

Figure 1:
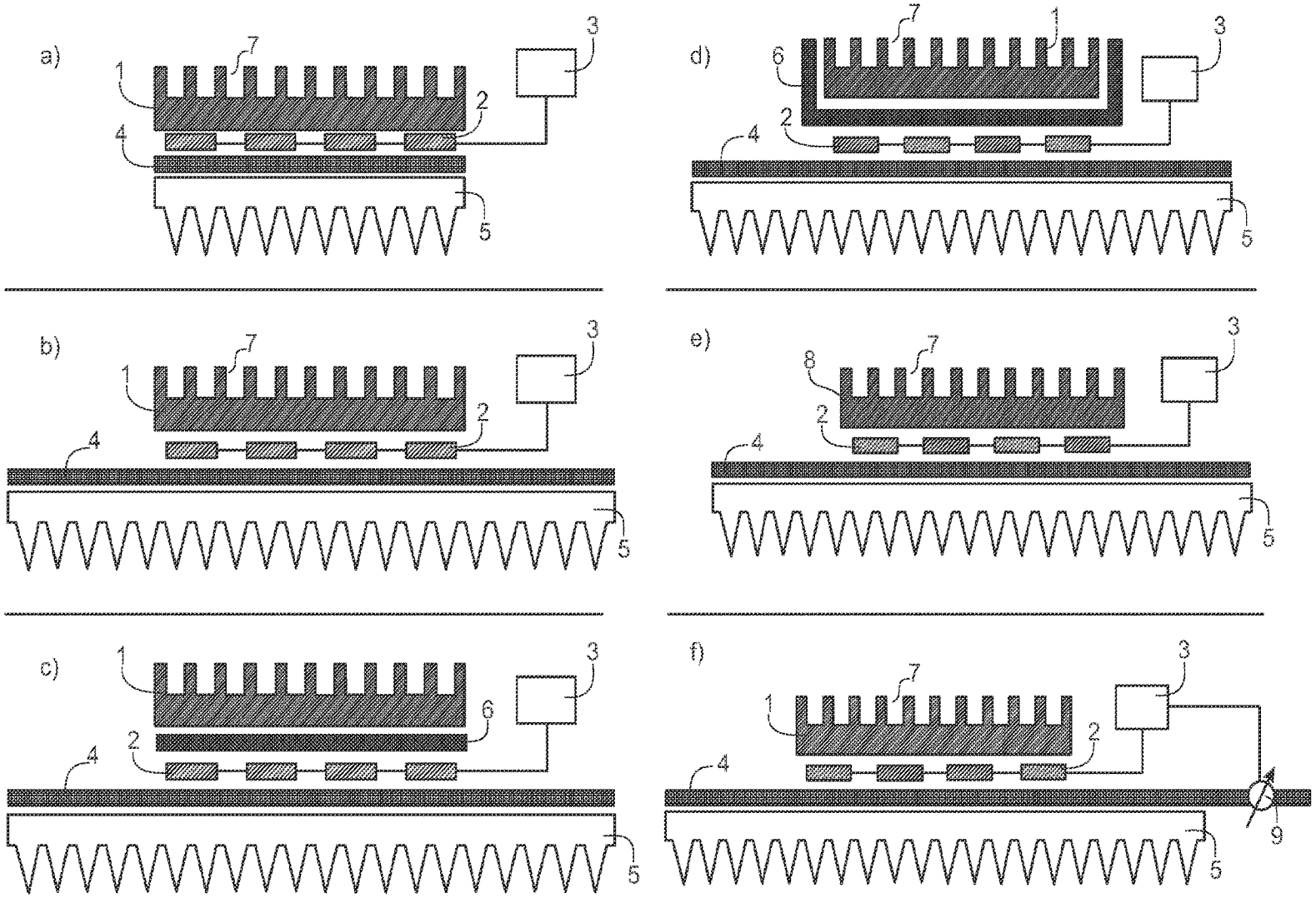
FIG. 1 Schematic pictures of several embodiments of the device according to the present invention.
Figure 2:
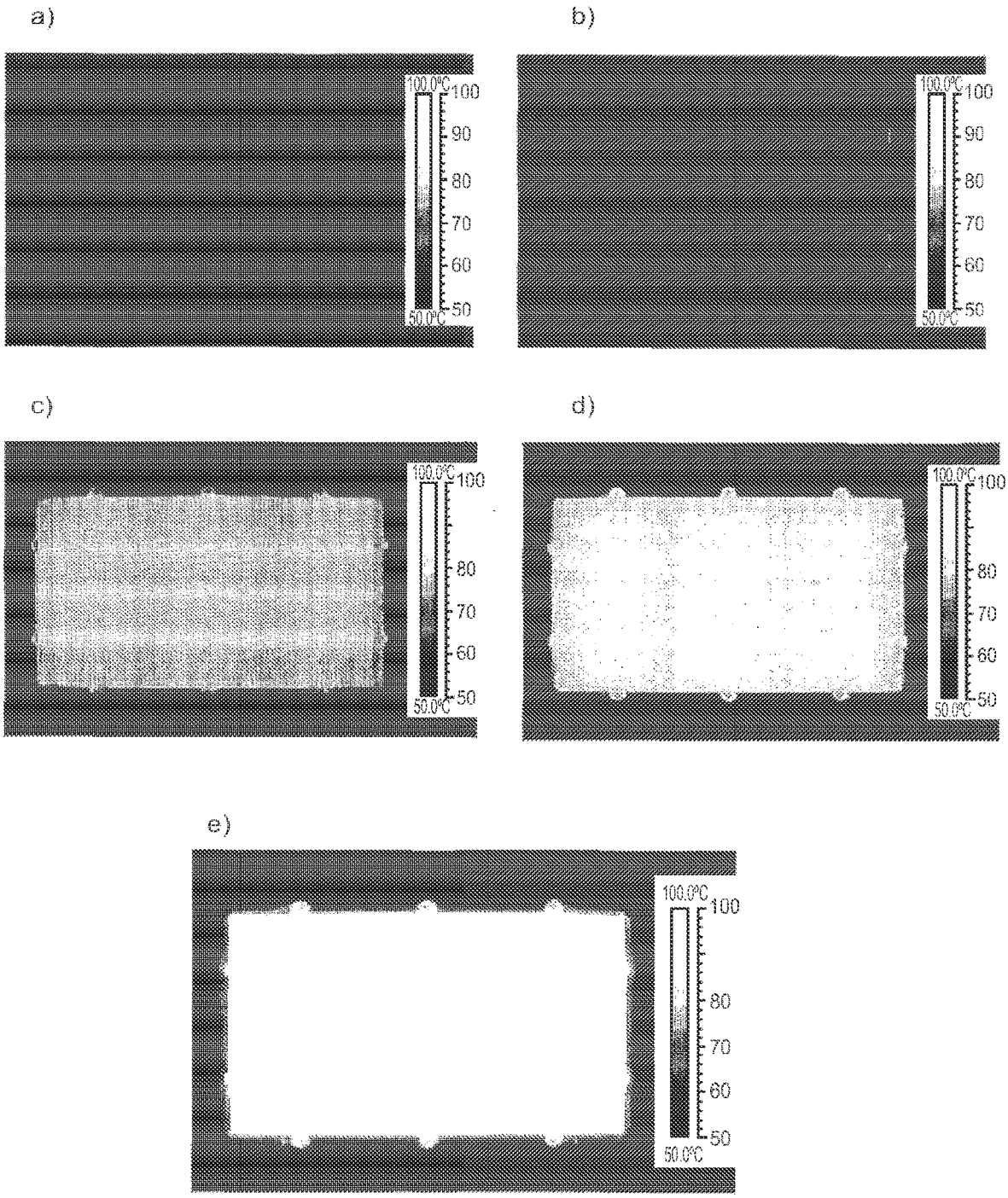
FIG. 2 Heat pictures of the thermal block during a heating procedure of the thermal block.
Figure 3:
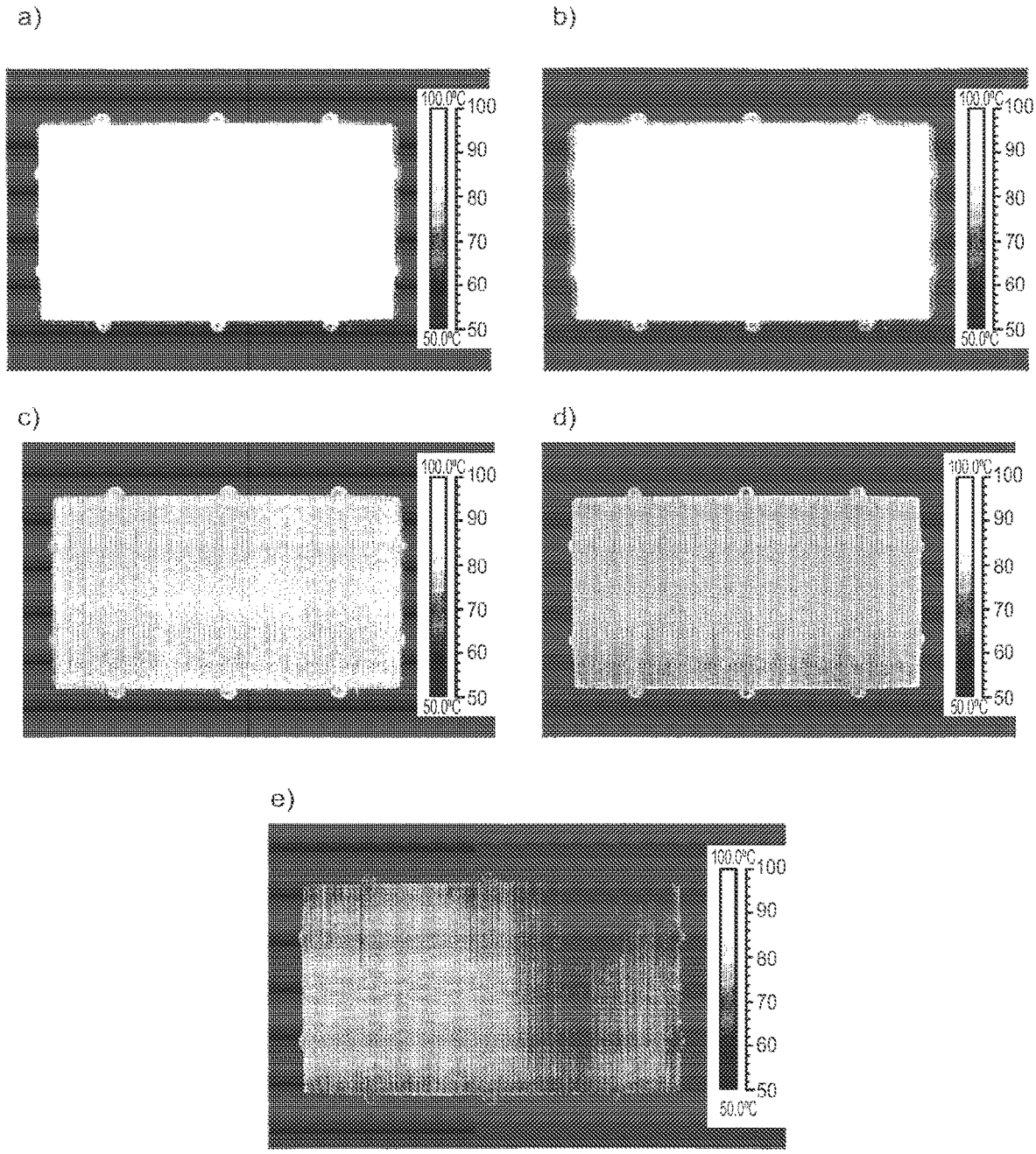
FIG. 3 Heat pictures of the thermal block during a cooling procedure of the thermal block.

Heat pictures of the thermal block of a device as described in Example 1 were recorded with an IR-camera (commercially available at the company FLIR) during a heating procedure (FIG. 2) and a cooling procedure (FIG. 3).

The heating procedure (FIG. 2) started at a temperature of 55° C. with a heating rate of 4° C./s until 95° C. were reached, whereas the cooling procedure (FIG. 3) started at a temperature of 95° C. with a cooling rate of 2° C./s until 55° C. were reached. The pictures were taking at different times during the heating procedure and cooling procedure, respectively.

Example 3

Figure 4:
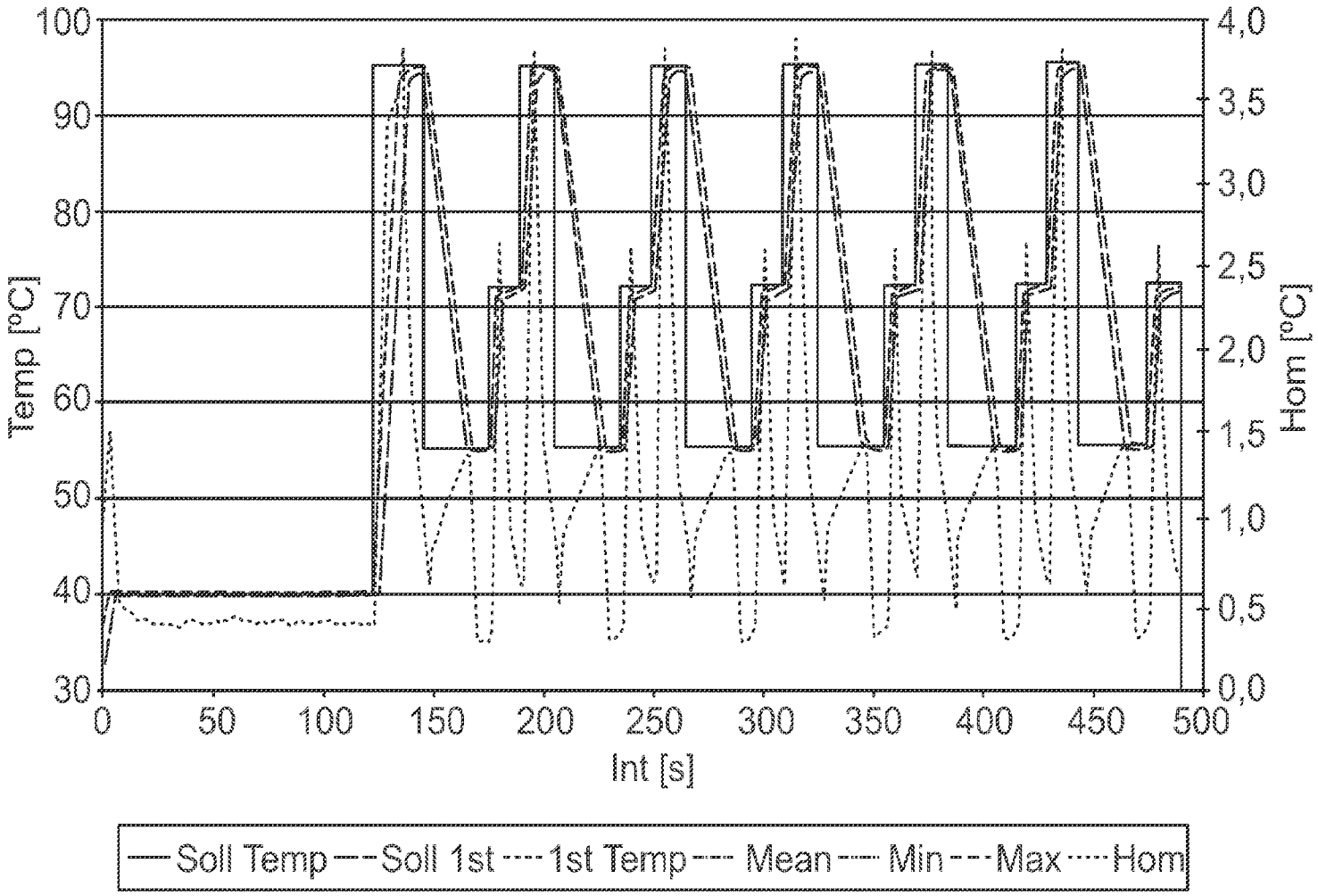
FIG. 4 Graph illustrating several temperatures associated with the thermal block as a function of time during the term of a thermocycling protocol comprising 6 cycles.

In FIG. 4 different characteristic temperatures of 6 successive temperature cycles of the following thermocycling protocol are plotted as a function of time:

| step | temp | ramp | hold time | number |
|---|---|---|---|---|
| PreCycle | 40° C. | 2.0° C./s | 120 sec | 1 |
| MainCycle | 95° C. | 4.4° C./s | 10 sec | 6 |
| | 55° C. | 2.0° C./s | 10 sec | |
| | 72° C. | 4.4° C./s | 10 sec | |

7 different temperature profiles are included in the figure, the temperature profile of the thermocycling protocol ('Soll Temp'), the theoretical temperature of the thermal block ('Soll Ist'), the measured temperature of the thermal block ('Ist Temp'), the mean temperature measured within 9 recesses of the thermal block ('Mean'), the minimal measured temperature of said 9 recesses of the thermal block ('Min'), the maximal measured temperature of said 9 recesses of the thermal block ('Max') and the homogeneity of the 9 recess measurements ('Hom'; homogeneity=maximal recess temperature−minimal recess temperature).

A standard multiwell plate was arranged in the recesses of the thermal block and 9 wells distributed across the cross section of the thermal block were filled with oil (Type Applied Biosystems, Nujol Nineral Oil, Part No. 0186-2302). The temperature was measured using a thermocouple (Thermocouples Omega 5TC-TT-36-72) for each recess. The temperature of the thermal block was measured with an internal temperature sensor within the thermal block.

Figure 5:
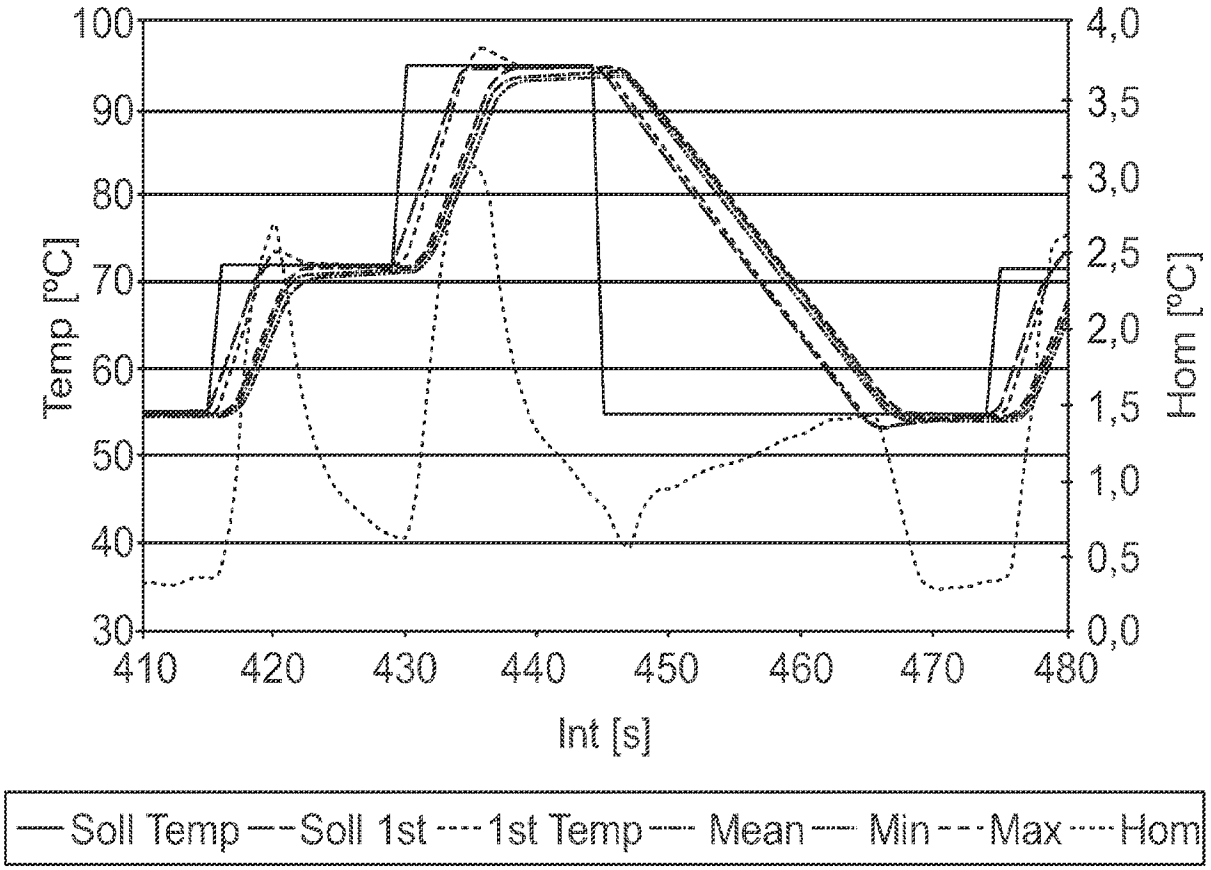
FIG. 5 Detailed graph illustrating several temperatures associated with the thermal block as a function of time during the term of one thermocycling cycle.

In FIG. 5 a magnification of the last cycle of the sequence is plotted to illustrate the different profiles in more detail.

Example 4

To further demonstrate the validity of the invention, real-time PCR amplifications of different target concentrations with a detection based on fluorescent-dye labelled hybridisation probes were performed using the apparatus described in Example 1. As a test system the real-time PCR amplification of a 177 bp fragment of the Parvovirus B19 (SEQ ID NO:1) was chosen. As fluorescent probe the HybridisationProbe pair (SEQ ID NO:4 and SEQ ID NO:5) of the LightCycler-Parvovirus B19 Quantification Kit (Roche Applied Science, Article No. 3 246 809) or SybrGreen was used. Results are displayed in FIG. 6 (HybridisationProbe pair) and FIG. 7 (SybrGreen).

PCR

A partial fragment of the parvovirus B19 sequence was cloned into a pCR™ 2.1 plasmid vector (Invitrogen). Parvovirus B19 plasmid DNA dilutions were prepared in 10 mM Tris-HCl, pH 8.3. Per PCR reaction $10^6$ to 100 copies of the plasmid target were used for amplification.

For PCR amplification the LightCycler—Parvovirus B19 Quantification Kit (Roche Applied Science, Article No. 3 246 809) was used. A typical PCR assay consisted of $10^6$ to 100 copies of Parvovirus B19 plasmid, reaction buffer, detection buffer and 1 U of FastStart Taq DNA polymerase according to manufacturer's instructions. The PCR protocol consisted of an initial denaturation step at 95° C. for 10 min, followed by 40 cycles of amplification at 95° C. for 10 s, 60° C. for 15 s and 72° C. for 10 s. Ramp rates were 4.8° C. for heating and 2.4° C. for cooling, respectively. PCR reactions were run in a total volume of 20 μl in a white 384-well microtiter plate (custom-made product of Treff, Switzerland).

Fluorescence emission was detected in each cycle at the end of the annealing step at 60° C. using a CCD camera coupled to an optical system comprising a telecentric lens in order to measure the fluorescence signals of all wells of the plate simultaneously. The used optical system is described in the European patent application EP 05000863.0 (filed Jan. 18, 2005). The HybridisationProbe pair was excited at 480 nm, whereas emission was measured at 640 nm. SybrGreen was excited at 470 nm, whereas emission was measured at 530 nm. Exposure time was set to 1000 ms.

Figure 6:
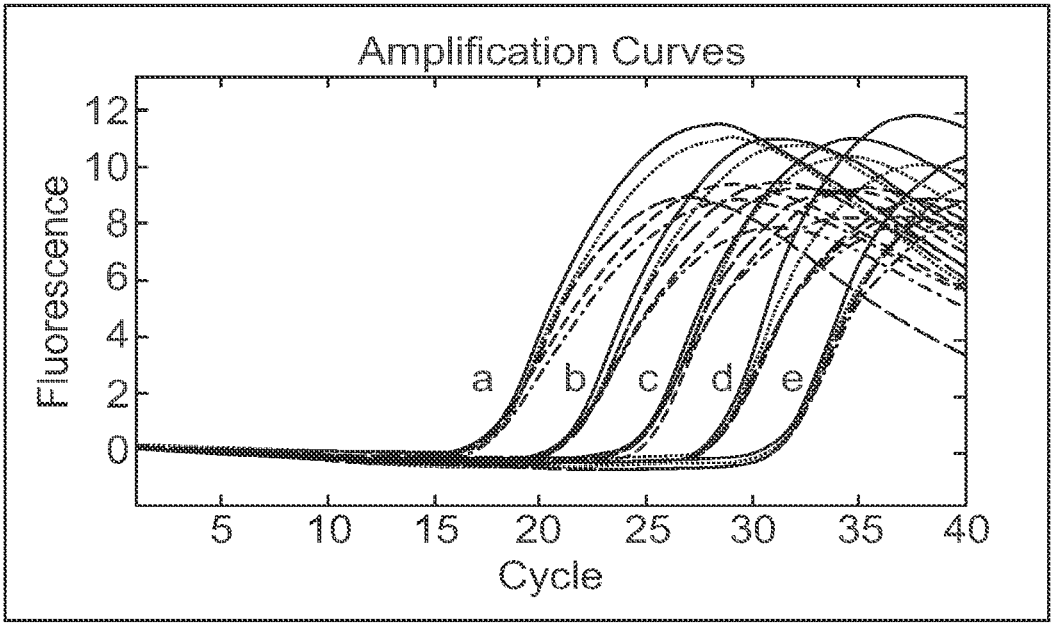
FIG. 6 Real-time amplification curves of a Parvovirus B19 fragment. Five different target concentrations were analysed by real-time PCR and each concentration is represented by five different wells of the plate. (a: $10^6$ copies; b: $10^5$ copies; c: $10^4$ copies; d: $10^3$ copies; e: $10^2$ copies).

In FIG. 6 amplification curves of 5 different target concentrations are plotted, whereas each target concentration is represented by 5 different wells (distributed across the 384 well plate). The groups of amplification curves based on the same target concentration are labelled with (a) $10^6$ copies (medium $C_p$ (elbow value) 16.6; SD 0.033), (b) $10^5$ copies (medium $C_p$ 20.1; SD 0.043), (c) $10^4$ copies (medium $C_p$ 23.5; SD 0.029), (d) $10^3$ copies (medium $C_p$ 26.9; SD 0.020), (e) $10^2$ copies (medium $C_p$ 30.4; SD 0.2).

Figure 7:
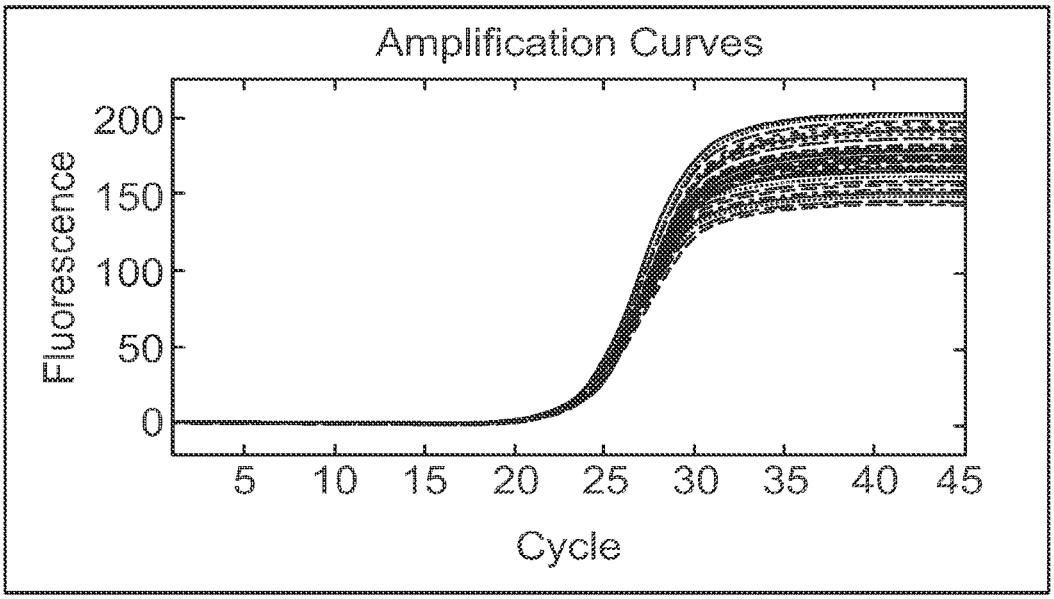
FIG. 7 Real-time amplification curves of a Parvovirus B19 fragment. 96 real-time amplification curves recorder in 96 different wells of a plate, each containing $10^4$ copies of the target sequence.

FIG. 7 comprises 96 real-time amplification curves recorder in 96 different wells of one 384 well plate, each containing $10^4$ copies of the target sequence. The 96 amplification reactions had an average $C_p$-value of 23.7 with a standard deviation of 0.08.

```
Sequence information of the Parvovirus B19
(positions of the primers are underlined)
SEQ ID NO: 1:
  1  cagaggttgt gccatttaat gggaagggaa ctaaggctag
     cataaagttt caaactatgg
 61  taaactggct gtgtgaaaac agagtgttta cagaggataa
     gtggaaacta gttgacttta
121  accagtacac tttactaagc agtagtcaca gtggaagttt
     tcaaattcaa agtgcactaa
181  aactagcaat ttataaagca actaatttag tgcctactag
     cgcattttta ttgcatacag
241  actttgagca ggttatgtgt attaaagaca ataaaattgt
     taaattgtta ctttgtcaaa
301  actatgaccc cctattggtg gggcagcatg tgttaaagtg
     gattgataaa aaatgtggca
361  agaaaaatac actgtggttt tatgggccgc caagtacagg
     aaaaacaaac ttggcaatgg
```

-continued

```
421  ccattgctaa aagtgttcca gtatatggca tggttaactg
     gaataatgaa aactttccat
481  ttaatgatgt agcaggaaaa agcttggtgg tctgggatga
     aggtattatt aagtctacaa
541  ttgtagaagc tgcaaaagct attttaggcg ggcaacccac
     cagggtagat taaaaaatgc
601  gtggaagtgt agctgtgcct ggagtacctg tggttataac
     cagcaatggt gacattactt
661  ttgttgtaag cgggaacact acaacaactg tacatgctta
     agccttaaaa gagcgaatgg
721  taaagttaaa ctttactgta ag
```

Sequences of PCR primers and probes:
PCR-primer sense (SEQ ID NO: 2):
5'-GGG GCA GCA TGT GTT AAA GTG G-3'

PCR-primer antisense (SEQ ID NO: 3):
5'-CCT GCT ACA TCA TTA AAT GGA AAG-3'

Acceptor probe (SEQ ID NO: 4):
5'-LCRed640-TTG GCG GCC CAT AAA ACC ACA GTG TAT-phosphate-3'

Donor probe (SEQ ID NO: 5):
5'-TGG CCA TTG CCA AGT TTG TTT TTC CTG T-Fluorescein-3'

Sequence of amplified fragment:
5'- g gggcagcatg tgttaaagtg gattgataaa aaatgtggca agaaaaatac actgtggttt tatgggccgc caagtacagg aaaaacaaac ttggcaatgg ccattgctaa aagtgttcca gtatatggca tggttaactg gaataatgaa aactttccat ttaatgatgt agcagg -3'

The invention claimed is:

1. A device for simultaneous thermocycling of multiple samples in a polymerase chain reaction (PCR) thermocycling protocol, the device comprising:

a thermal block;

a heat sink;

at least one actively controlled thermoelectric based heat pump; a liquid-vapor equalization based first thermal base in thermal contact with and sandwiched directly in-between the heat pump and the heat sink;

a liquid-vapor equalization based second thermal base in thermal contact with and sandwiched directly in-between the thermal block and the heat pump;

a first switch configured to vary at least one heat conducting property of the first thermal base during a thermocycling protocol;

a second switch configured to vary at least one heat conducting property of the second thermal base during a thermocycling protocol;

and a computer operationally configured to control power supply to the at least one heat pump and to control the first switch and the second switch to independently vary the heat conducting properties of the first and the second thermal bases;

wherein the at least one thermoelectric based heat pump is in thermal contact with and directly adjacent the second surface of the second thermal base and the first surface of the first thermal base; and wherein the thermal block comprises a shape defined by a pair of sidewall outer surfaces and a bottom surface disposed therebetween, and the second thermal base comprises a corresponding shape comprising inner surfaces sized and shaped to thermally contact the pair of sidewall outer surfaces and the bottom surface of the thermal block.

2. The device of claim 1, wherein the heat pump comprises at least two thermoelectric based heat pumps.

3. The device of claim 2, wherein the computer is operationally configured to control the power supply to the at least two heat pumps.

4. The device of claim 1, wherein the first switch is on the first thermal base and the second switch is on the second thermal base.

5. The device of claim 1, wherein the computer is operationally configured to independently vary the heat conducting properties of the first thermal base via the first switch by changing volume and/or flow rate within the first thermal base.

6. The device of claim 1, wherein the computer is operationally configured to independently vary the heat conducting properties of the second thermal base via the second switch by changing volume and/or flow rate within the second thermal base.

7. The device of claim 1, wherein the thermocycling protocol comprises nucleic acid amplification.

8. The device of claim 1, wherein the first thermal base, the second thermal base, the heat sink, and the thermal block each have a cross section area, the cross section area of the first thermal base being less than 20% larger than the cross section area of the heat sink, wherein the cross section area of the second thermal base is larger than the cross section area of the thermal block, wherein the cross section areas are in parallel to respective contact areas, such that heat transfer to and from the first and second thermal bases comprises homogenous heat transfer across the cross-sectional areas of the heat sink and thermal block, respectively.

9. The device of claim 1, wherein the first thermal base is configured to aid a cooling procedure by distributing heat to be dissipated homogeneously across an entire surface of the heat sink.

10. The device of claim 1, wherein the second thermal base is configured to aid a heating procedure by distributing heat generated at the heat pump homogenously across the thermal block.

* * * * *